United States Patent [19]

Zeliszkewycz

[11] 4,155,334

[45] May 22, 1979

[54] FUEL VAPOR INJECTOR FOR INTERNAL COMBUSTION ENGINE

[76] Inventor: Stefan Zeliszkewycz, 1854 N. Lake Dr., Troy, Mich. 48084

[21] Appl. No.: 783,643

[22] Filed: Apr. 1, 1977

[51] Int. Cl.[2] ..... F02B 25/08

[52] U.S. Cl. ..... 123/51 A; 123/75 B; 123/139 AK

[58] Field of Search ..... 123/51 A, 51 AA, 68, 123/71 R, 75 B, 74 A, 139 AK

[56] References Cited

U.S. PATENT DOCUMENTS

| | | | |
|---|---|---|---|
| 938,401 | 10/1909 | Treat | 123/51 A |
| 1,126,713 | 2/1915 | Crew | 123/51 A |
| 1,476,309 | 12/1923 | Toth | 123/51 A |
| 1,624,404 | 4/1927 | Frese | 123/51 A |
| 1,714,364 | 5/1929 | Hall | 123/51 A |
| 2,183,527 | 12/1939 | Alarie | 123/51 A |
| 2,369,738 | 2/1945 | Johnson | 123/51 A |
| 2,481,872 | 9/1949 | Prieto | 123/74 A |
| 3,217,698 | 11/1965 | Mitrowke | 123/74 A |
| 3,446,192 | 5/1969 | Woodward | 123/51 A |
| 3,923,019 | 12/1975 | Yamada | 123/DIG. 4 |
| 3,934,562 | 1/1976 | Isaha | 123/DIG. 4 |

FOREIGN PATENT DOCUMENTS

| | | | |
|---|---|---|---|
| 2241643 | 4/1974 | Fed. Rep. of Germany | 123/DIG. 4 |

*Primary Examiner*—Charles J. Myhre
*Assistant Examiner*—David D. Reynolds
*Attorney, Agent, or Firm*—Krass & Young

[57] ABSTRACT

An injector arrangement is disclosed for injecting a prevaporized fuel-air mixture into the cylinder of an internal combustion piston engine, the injector comprising an auxiliary piston and cylinder arrangement associated with each cylinder of the internal combustion engine and adapted to act as the combustion chamber for the piston and cylinder with which it is associated, as well as to inject a charge of compressed prevaporized fuel into the auxiliary cylinder acting as a combustion chamber. The compressor arrangement includes an auxiliary double acting piston disposed in the auxiliary cylinder, which cylinder is in communication with the main cylinder at its top, the auxiliary double acting piston being reciprocated by a linkage driven by the engine so as to be reciprocated at one-half the cyclical speed of the reciprocation of the main piston and cylinder. The piston moves downwardly to induct a charge of a prevaporized fuel mixture above the piston and then compress the charge upon movement of the piston upwardly, with a slotted port arrangement allowing injection of the compressed prevaporized fuel charged into the space beneath the auxiliary double acting piston upon the piston approaching the topmost extent of travel, which charge mixes with the main air supply compressed into the space beneath the auxiliary double acting piston by reciprocation of the main piston such that combustion takes place in that space. The auxiliary double acting piston acts to expel the residual exhaust gas from the combustion chamber during the exhaust stroke.

7 Claims, 2 Drawing Figures

FUEL VAPOR INJECTOR FOR INTERNAL COMBUSTION ENGINE

BACKGROUND OF THE INVENTION

1. Field of the Invention

This invention concerns internal combustion engines, and more particularly, a compressor arrangement for injecting a quantity of a prevaporized fuel mixture into the cylinders of a piston and cylinder type internal combustion engine.

2. Description of the Prior Art

In copending Ser. No. 512,944, filed Oct. 7, 1974, a fuel delivery system is disclosed for internal combustion engines, which fuel delivery system involves the prevaporization of fuel in a small quantity of air which mixture is injected into the engine combustion chamber by compressor-injectors associated with each cylinder, to be burned in a relatively large quantity of primary air inducted into each cylinder.

The present invention is concerned with a specific design for such compressor-injectors which design may be utilized in such system to great advantage in that it is relatively simple and adapted to cooperate with the engine pistons to control the injection of the fuel mixture and also act as the engine combustion chamber.

SUMMARY OF THE INVENTION

The compressor-injector, according to the present invention, includes an auxiliary double acting piston and cylinder arrangement associated with each cylinder in the internal combustion engine, the auxiliary piston adapted to be reciprocated by a driving relationship with the engine cam shaft such as to reciprocate (in four cycle engines) at one-half the cyclical frequency of the main piston and cylinder. The auxiliary piston acts to compress a quantity of the fuel-air mixture delivered to the compressor-injector and inject the same in timed relationship, as the main piston reaches top dead center completing the compression stroke. When the auxiliary double acting piston is in its topmost position, the space in the auxiliary cylinder beneath the piston acts as the cylinder combustion chamber and the main piston compresses the primary quantity of air into the space with the injection of the fuel mixture into the compressed primary air producing ignition. The auxiliary double acting piston decends in timed relationship with the exhaust stroke of the main cylinder piston to cooperate to expel the exhaust gases from the combustion chamber. The auxiliary cylinder is provided with bypass slots which are uncovered at a predetermined point in the compression travel of the auxiliary double acting piston to allow the lower part of the compressed mixture to bypass the auxiliary piston and thereby be injected into the auxiliary cylinder.

DETAILED DESCRIPTION

In the following detailed description certain specific terminology will be utilized for the sake of clarity, and a specific embodiment described in accordance with the requirements of 35 USC 112, but it is to be understood that the present invention is not so limited and it may take many forms within the scope of the appended claims.

Figure 1:
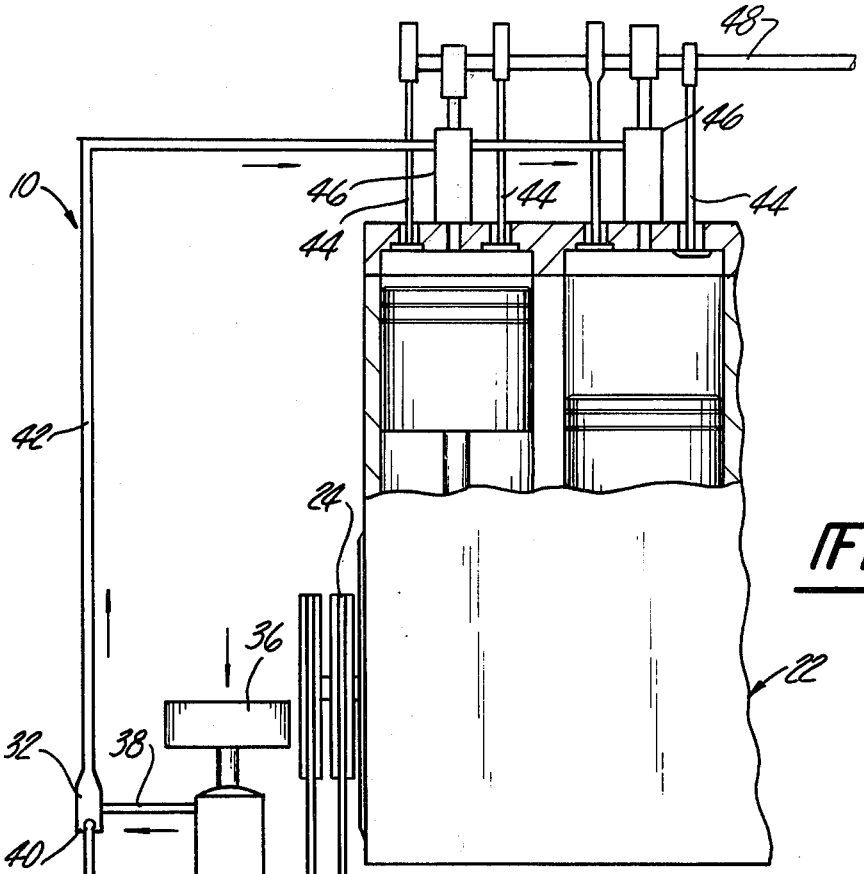
FIG. 1 is a diagrammatic representation of the fuel delivery system into which the compressor-injector of the present invention is incorporated. It is understood however that FIG. 1 depicts only one of many fuel delivery systems suitable for incorporation of said compressor-injector.

Referring to FIG. 1, the fuel delivery system as disclosed in the copending Ser. No. 512,944, filed Oct. 7, 1974, is disclosed and includes a fuel pump 12 of conventional design having a variable speed mechanical drive control device 14, associated therewith, operated by means of a flexible control cable 16 connected to an accelerator pedal lever 18. Such variable speed devices are well known and can take the form of variable pitch pulley 20, driven from the engine 22 by means of a pulley 24 and belt 26, the flexible cable 16 serving to vary the mechanical ratio of the variable pitch pulley 20 to thereby control the speed of the fuel pump 12. The fuel pump 12 is adapted to receive liquid fuel via tube 28 in communication with a vehicle fuel tank, not shown, and deliver its output to fuel line 30, the variation and speed of variable pitch pulley 20 producing a variation in the quantity of fuel delivered into the fuel line 30 to a fuel mixing chamber 32.

An air compressor 34 is also included which may be of a design such as is disclosed in co-pending Ser. No. 512,944 filed Oct. 7, 1974, Attorney Docket No. SNZ-302. Air compressor 34 is adapted to receive air via an air cleaner intake 36 and compress the same between 3 to 10 atmospheres or higher depending on the particular application, and deliver the same through passage 38 through mixing chamber 32. The liquid fuel is sprayed into the mixing chamber 32 by being forced through an atomization nozzle 40 where it mixes with the compressed air delivered through passage 38 to thereby produce the mixture of vaporized fuel and air.

The fuel air mixture is delivered to each of the engine 22 cylinders by means of a fuel line 42, as described in the above-mentioned co-pending patent application, Ser. No. 512,944. The mixture produced in mixing chamber 32 is of an over-rich, non-stoichiometric non-combustible mixture, the total quantity of mixture containing a fraction of the air burned in a given charge in the engine cylinders on the order of less than 10% of the total charge, the remainder of the air in each charge being taken in conventionally through the engine intake valve 44. Thus, the mixture contained in the delivery line 42 can be safely further compressed in the compressor-injectors 46, according to the present invention without danger of explosion. It is also noted that, as described in the referenced patent application, the quantity of auxiliary air is constant per one revolution of the engine 22, but can receive varying quantities of fuels by virtue of the accelerator lever 18 manipulation. The compressor-injectors 46 are operated by virtue of a driving connection with the overhead cam shaft 48 which will also operate the engine valving, as indicated.

Figure 2:
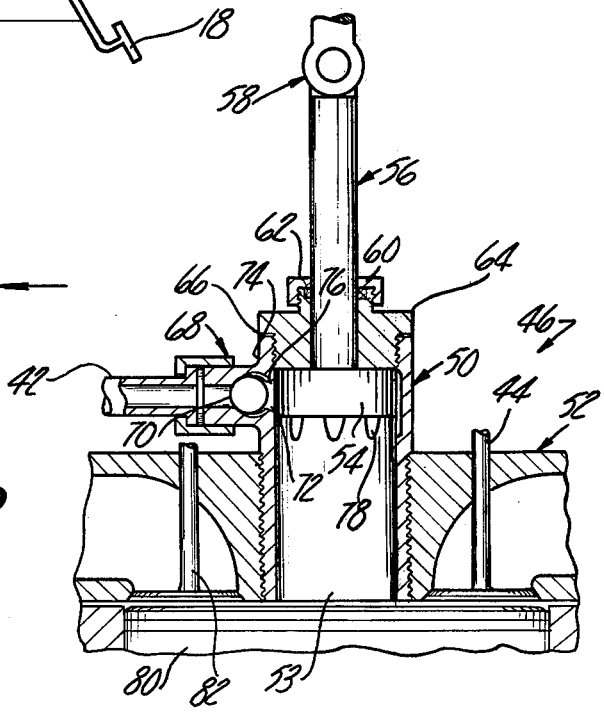
FIG. 2 is a view in partial section of an individual engine piston and cylinder incorporating a compressor-injector arrangement according to the present invention.

Depicted in FIG. 2, is one of the compressor-injectors 46, shown together with a portion of its associated engine cylinder, which compressor-injector 46 includes an auxiliary double acting piston and cylinder arrangement consisting of a body member 50 threadably received in a bore formed in the engine cylinder head 52, having its open end opening into communication with the upper region of the main engine cylinder, as shown in FIG. 2. Slidably disposed within the body menber 50 of the auxiliary cylinder is an auxiliary double acting piston 54, which is adapted to be reciprocated within the auxiliary cylinder 53 formed within body member 50 by means of an operating rod 56 which is linked at 58 to an appropriate rocker arm or other linkage to the overhead cam 48, so as to be reciprocated in the auxiliary cylinder 53 (in four cycle engines) at one-half the cyclical frequency of the reciprocation of the main piston in the main engine cylinder. A seal retainer 60 and seal 62 are provided to seal the clearance space between the actuating rod 56 and a bore formed in end cap 64 of the body member 50. The end cap 64 likewise is threadably received within the body member 50 with a gasket 66 provided. The auxiliary cylinder 53 is adapted to receive a quantity of fuel mixture via line 42 by means of a check valve 68, which is provided with a valve ball 70 disposed in an opening 72 formed in a protuberance 74 formed on the body member 50, with relief slots 76 provided such that the valve ball 70 allows induction of the vapor via line 42 into the space above the auxiliary double acting piston 54 when the piston is reciprocated downwardly, but prevents exiting of the vapor upon compression thereof induced by reciprocation of the auxiliary double acting piston 54 upwardly.

A plurality of valving slots 78 are provided in the interior surface of the auxiliary cylinder 53 in the region of the upper portion thereof which acts as a valving arrangement. That is, as auxiliary piston 54 moves upwardly, it progressively compresses the charge of fuel vapor-air mixture which was previously inducted into the space above the piston 54, until auxiliary piston 54 reaches a point in its upward travel sufficient to uncover the valving slots 78. At this point, the compressed fuel vapor-air mixture is allowed to bypass the auxiliary double acting piston 54 and be injected into the space beneath the auxiliary double acting piston 54 and inside auxiliary cylinder 53 that is acting as a combustion chamber in four cycle engines.

The operation of this device is in timed relationship with the movement of the main piston 80 and the auxiliary double acting piston 54. In the initial position, as shown in FIG. 2, injection of the fuel mixture will have just taken place and the resulting combustion of the mixture in the quantity of primary air which has previously been induced into the main cylinder via intake valve 44, produces the power stroke of the main piston 80. The auxiliary double acting piston 54, moving at one-half the cyclical frequency of the main piston 80, will have proceeded only halfway downward at the full bottom dead center position of the main piston 80, and will be just approaching its own bottom dead center upon the main piston 80 again reaching top dead center. This produces a complete scavenging of the products of combustion out the exhaust valve 82. In the meantime a fresh fuel mixture charge has been inducted into the region above the auxiliary double acting piston 54, and the auxiliary double acting piston 54 then proceeds to be reciprocated upwardly to compress this mixture while the main piston 80 descends and again returns to the top dead center position after having inducted a charge of primary air by virtue of the intake valve 44 opening. The main piston 80 acts to compress this charge of primary air into the auxiliary cylinder 53 which, thus, acts as the engine combustion chamber. At this point, the valving port 78 becomes fully uncovered to allow the compressed fuel-air mixture to be injected into the auxiliary cylinder 53, to reinitiate the power stroke.

It should be noted that the clearance space between the main piston 80 and the cylinder head 52 was minimal since the auxiliary cylinder, as noted, may act as the engine combustion chamber.

It can be appreciated that this design is very simple, inasmuch as no timed valving is required and very thorough scavenging of the exhaust gases are produced since the remaining clearance space between the auxiliary double acting piston and the main piston 80 is virtually nil. Modifications are, of course, possible, such as replacement of the valving produced by the valving slot 78 with a spring discharge valve opening upon attainment of sufficiently high pressures from the charge.

The embodiments of the invention in which an exclusive property or privilege is claimed are defined as follows:

1. A compressor-injector in combination with an internal combustion engine including a main cylinder and main piston, and intake and exhaust valving opened and closed in timed relationship with reciprocation of said main piston and means for inducting air into said main cylinder through said intake valve, said compressor-injector comprising: an auxiliary cylinder positioned in communication with said engine main cylinder above said main piston; an auxiliary double acting piston slidably disposed in said auxiliary cylinder; means for reciprocating said auxiliary double acting piston in said auxiliary cylinder in timed relationship with reciprocation of said engine main piston to produce movement of said auxiliary double acting piston to its extreme up position when said engine main piston is in its compression position and said auxiliary piston is in its extreme down position when said engine main piston is in its exhaust position; means for inducting a charge of fuel vapor and air mixture above said auxiliary double acting piston when said double acting auxiliary piston moves to its down position; means producing compression of said charge of fuel vapor and air mixture in said auxiliary cylinder by upward movement of said double acting piston therein; means for injecting of said compressed mixture into the lower portion of said auxiliary cylinder as said double acting auxiliary piston approaches the uppermost position in said auxiliary cylinder and as said main piston approaches its full compression position in said main cylinder.

2. The internal combustion engine according to claim 1 wherein said means for injecting said compressed fuel vapor charge includes a plurality of longitudinal valving relief slots formed in the upper portion of said auxiliary cylinder inner wall and uncovered by upward movement of said auxiliary double acting piston, said uncovering of said valving relief slots causes injecting of said charge compressed above said auxiliary double acting piston by bypass flow of said compressed charge through said slots and around said auxiliary double acting piston after said main piston has compressed the air inducted into the main cylinder, whereby combustion of said charge injected into said auxiliary cylinder is carried out in said air compressed by said main piston.

3. The internal combustion engine according to claim 1 wherein said means for inducting a charge produces an over-rich noncombustible charge above said auxiliary double acting piston.

4. The internal combustion engine according to claim 1 wherein said means for inducting said over-rich noncombustible mixture of fuel vapor and air comprises an intake nozzle in the extreme upper part of said auxiliary cylinder.

5. The internal combustion engine according to claim 1 wherein said means producing compression of said charge of fuel vapor and air comprises a check valve within said intake nozzle and a gas tight cover rigidly attached to the upper end of said auxiliary cylinder, said check valve admitting said over-rich noncombustible mixture of fuel vapor and air during downward travel of said auxiliary double acting piston and trapping said over-rich noncombustible mixture of fuel vapor and air during upward travel of said auxiliary double acting piston causing said mixture to compress in total separation from air inducted into said main cylinder.

6. The internal combustion engine according to claim 1 wherein said means for reciprocating said auxiliary double acting piston includes a rod connected to said auxiliary double acting piston extending through said upper end cover of said auxiliary cylinder.

7. The internal combustion engine according to claim 1 wherein said internal combustion engine comprises a four cycle engine and wherein said means for reciprocating said auxiliary double acting piston produces reciprocation thereof at a frequency of one-half the frequency of reciprocation

* * * * *

UNITED STATES PATENT AND TRADEMARK OFFICE

CERTIFICATE OF CORRECTION

PATENT NO. : 4,155,334

DATED : May 22, 1979

INVENTOR(S) : Stefan Zeliszkewycz

It is certified that error appears in the above–identified patent and that said Letters Patent are hereby corrected as shown below:

Column 6, line 13 "of said main piston" has been left out.

Signed and Sealed this

*Thirteenth* Day of *January 1981*

[SEAL]

*Attest:*

*Attesting Officer*

SIDNEY A. DIAMOND

*Commissioner of Patents and Trademarks*